US005591523A

United States Patent [19]

Aneja

[11] Patent Number: 5,591,523

[45] Date of Patent: Jan. 7, 1997

[54] POLYESTER TOW

[75] Inventor: Arun P. Aneja, Greenville, N.C.

[73] Assignee: E. I. Du Pont de Nemours and Company, Wilmington, Del.

[21] Appl. No.: 497,495

[22] Filed: Jun. 30, 1995

[51] Int. Cl.[6] ..... D02G 3/00

[52] U.S. Cl. ..... 428/357; 428/397; 428/400

[58] Field of Search ..... 428/397, 400, 428/357

[56] References Cited

U.S. PATENT DOCUMENTS

| | | | |
|---|---|---|---|
| 3,022,880 | 2/1962 | Newman | 428/397 |
| 3,335,211 | 8/1967 | Mead et al. . | |
| 4,092,299 | 5/1978 | MacLean et al. | 264/210 |
| 4,113,704 | 9/1978 | MacLean et al. | 528/289 |
| 4,634,625 | 1/1987 | Franklin | 428/397 |
| 4,707,407 | 11/1987 | Clark et al. | 428/397 |
| 4,833,032 | 5/1989 | Reese | 428/364 |
| 4,954,398 | 9/1990 | Bagrodia | 428/397 |
| 4,996,107 | 2/1991 | Raynolds et al. | 428/397 |
| 5,188,892 | 2/1993 | Grindstaff | 428/397 |
| 5,234,645 | 8/1993 | Grindstaff | 264/103 |
| 5,308,564 | 5/1994 | Grindstaff | 264/103 |

OTHER PUBLICATIONS

Dictionary of Fiber & Textile Technology p. 9 date 1965.

*Primary Examiner*—Newton Edwards

[57] ABSTRACT

Tow that is suitable for processing on a worsted or woollen system consists essentially of continuous polyester filaments that are a mixture of filaments of higher denier and of lower denier and that have a scalloped-oval or other cross-section that is of generally oval shape, but with grooves or channels that run along the length of the filaments. Such polyester tows provide improved processing on the worsted system to provide spun yarns of polyester and blends with wool, and downstream articles, such as fabrics and garments.

1 Claim, 9 Drawing Sheets

POLYESTER TOW

FIELD OF INVENTION

This invention relates to new polyester tow, and is more particularly concerned with polyester tow that is suitable for conversion to a worsted or woollen system sliver and downstream processing on such systems, and to processes relating thereto and products therefrom.

BACKGROUND OF THE INVENTION

All synthetic fibers, including polyester fibers, can be classified into two groups, namely (1) continuous filaments and (2) fibers that are discontinuous, which latter are often referred to as staple fibers or cut fibers. This invention provides improvements relating to the processing of the latter group, but such polyester staple fibers have first been formed by extrusion into continuous polyester filaments, which are processed in the form of a tow of continuous polyester filaments.

This invention provides a new tow of continuous polyester filaments that provides advantages in being capable of better processing downstream on the worsted system.

Mostly, the objective of synthetic fiber producers has been to replicate advantageous properties of natural fibers, the most common of which have been cotton and wool fibers. Most of the polyester cut fiber has been blended with cotton. A typical spun textile yarn is of cotton count 25, and of cross-section containing about 140 fibers of 1.5 dpf (denier per filament) and 1.5 inch length. Polyester/worsted yarns are different, typically being of worsted count 23, and of cross-section containing about 60 fibers for single yarn and about 42 fibers for bi-ply yarn, with fibers that have been of 4 dpf and 3.5 inch length. The yarn count may vary over 55 worsted to 10 worsted, while the denier and length may vary up to about 4.5 and down to about 3. It is only relatively recently that the advantages of using synthetic fibers of dpf lower than the corresponding natural fibers (such as wool) have been found practical and/or been recognized. Recent attempts to provide low dpf polyester fiber for blending with wool on the worsted system have not, however, been successful, and require improvement. As the fiber denier has been reduced, the fibers have become harder to process (carding, drafting, gilling, etc.) in the mill. In fact, below a certain fiber denier, the polyester fibers that I have tried have been practically impossible to process, and/or have given poor quality fabrics. Thus, for commercially-acceptable processing and blending with wool in practice, I have found that the fiber denier of such polyester fibers has had to be a minimum of about 3 dpf. Tows of (nominal) dpf less than 3 are not believed available commercially at this time. This has been the status so far in the trade. Thus far, trying to manipulate a desire to reduce dpf has appeared to be contradictory or incompatible with satisfactory mill processibility.

Processing on the worsted system is entirely different from most practice currently carried out on the cotton system, which generally uses cotton fiber that is sold in bales and that may be mixed with polyester fiber that is primarily staple or cut fiber, that is also sold in compacted bales. In contrast, for processing on their system, worsted operators want to buy a tow of polyester fiber (instead of a compacted bale of cut fiber) so they can convert the tow (which is continuous) into a continuous sliver (a continuous end of discontinuous fibers, referred to hereinafter shortly as "cut fiber") by crush cutting or stretch-breaking. This sliver is then processed (as a continuous end) through several stages, i.e., drafting, dyeing, back-washing, gilling, pin-drafting and, generally, finally blending with wool. It is very important, when processing on the worsted system, to maintain the continuity of the sliver. Also, however, it is important to be able to treat the cut fiber in the sliver appropriately while maintaining a reasonably satisfactory processing speed for the continuous sliver. As indicated, recent attempts to use desirable polyester tow, e.g., with low dpf, have not produced desired results. For instance, unsatisfactorily low machine productivity rates have been required after dyeing; I believe this may have been because such polyester fiber has previously packed together too tightly.

SUMMARY OF THE INVENTION

According to one aspect of the invention, there is provided a tow that is suitable for processing on a worsted or woollen system and that consists essentially of continuous polyester filaments of average denier per filament up to about 4.5, wherein said polyester is a chain-branched polymer, said filaments are a mixture of filaments of higher denier per filament and filaments of lower denier per filament, said lower denier is 0.5 to 2.5 denier per filament and said higher denier is 2 to 5 denier per filament and is at least 1.5 times said lower denier, said filaments have a cross-section that is of generally oval, i.e., scalloped-oval shape with grooves (i.e., scallops), and said grooves run along the length of the filaments.

I believe that polyester tow of intentionally mixed denier has not previously been sold for processing on the woollen or worsted system. Such polyester tow is usually sold in large tow boxes. I believe boxes of such polyester tow of intentionally mixed denier have not previously been sold for processing on such systems. It is the downstream products and processing that the advantages of the invention are mainly demonstrated, as will be illustrated hereinafter. Such advantages are particularly significant for lower dpf products, but improvements are also available for normal dpfs.

There are also provided, therefore, such downstream products, according to the invention, especially continuous worsted system polyester (cut) fiber slivers, and yarns, fabrics, and garments from such slivers, including from blends of polyester fiber and of wool fiber and/or, if desired, other fibers, and processes for their preparation and/or use.

According to a preferred aspect of the invention, there is provided a process for preparing a tow of drawn, crimped polyester filaments for conversion into polyester worsted yarns, wherein the tow is a mixture of polyester filaments of intentionally different deniers, such process comprising the steps of forming bundles of filaments of denier that differ as desired from polyester polymer prepared with a chain-branching agent, and of generally oval shape with grooves that run along the length of the filaments, by spinning through capillaries at different throughputs preferably on the same spinning machine, by using radially-directed quench air from a profiled quench system, of collecting such bundles of filaments of different denier, and combining them into a tow, and of subjecting the filaments to drawing and crimping operations in the form of such tow.

BRIEF DESCRIPTION OF DRAWINGS

FIG. 1 shows a mixture of filaments of higher dpf and of lower dpf according to the invention;

FIGS. 2 and 3 show different examples of generally oval filament cross-sections with grooves that run along the length of the filaments, such as may be used (in mixtures of higher and lower dpf) in tows according to the invention, including downstream products.

FIGS. 8 and 9 plot coefficient of friction versus speed for mixed denier scalloped-oval cross-section filaments and for single dpf (i.e., unmixed) round cross-section filaments, FIG. 8 being for fiber-to-fiber friction, while FIG. 9 is for fiber-to-metal friction.

DETAILED DESCRIPTION OF THE INVENTION

As indicated, this invention is concerned with polyester filament tows that are suitable for processing on the worsted or woollen systems. Presently, such tows as are available commercially are believed to have been bundles of crimped, drawn continuous filaments of round filament cross-section and of denier generally about 900,000, each filament being of about 3 denier. Denier is the weight in grams of 9000 meters of fiber and thus a measure in effect of the thickness of the fiber. When one refers to denier, the nominal or average denier is often intended, since there is inevitably variation along-end and end-to-end, i.e., along a filament length and between different filaments, respectively. In general, it has been the objective of fiber producers to achieve as much uniformity as possible in all processing steps along-end and end-to-end so as to produce a polyester fiber of round cross-section and of a single denier and of as uniform denier as practical. This is present commercial practice in producing tows for processing on the worsted system. In contrast, my invention provides polyester tows of mixed dpf, using filaments of different (non-round) cross-section, and uses chain-branched polymer.

Grindstaff, in U.S. Pat. Nos. 5,188,892, 5,234,645, and 5,308,564 did disclose mixing polyester filaments of different dpfs (and, if desired, different cross-sections) for a different purpose. Grindstaff was concerned with providing polyester cut fiber for processing on the cotton system, which is quite different and has different requirements. Grindstaff did not teach a tow of filaments of my type of cross-section, nor of my type of polymer (chain-branched), nor of my quench system, nor for my purpose or end-use, albeit he taught mixing deniers (of filaments of his types). Grindstaffs disclosure is, however, expressly incorporated herein by reference hereby, as his disclosure explains many of the steps of preparing a polyester filamentary tow, despite the differences, such as the actual filaments he used and the different intended purpose. The present invention is, however, directed primarily at providing polyester tow (crimped, drawn polyester filaments in a large bundle, and including the resulting sliver) for processing on the worsted system, the requirements for which are known in the art and differ to some degree from those for the cotton system.

The terms "fiber" and "filament" are often used herein inclusively, without intending that use of one term should exclude the other.

Figure 1:
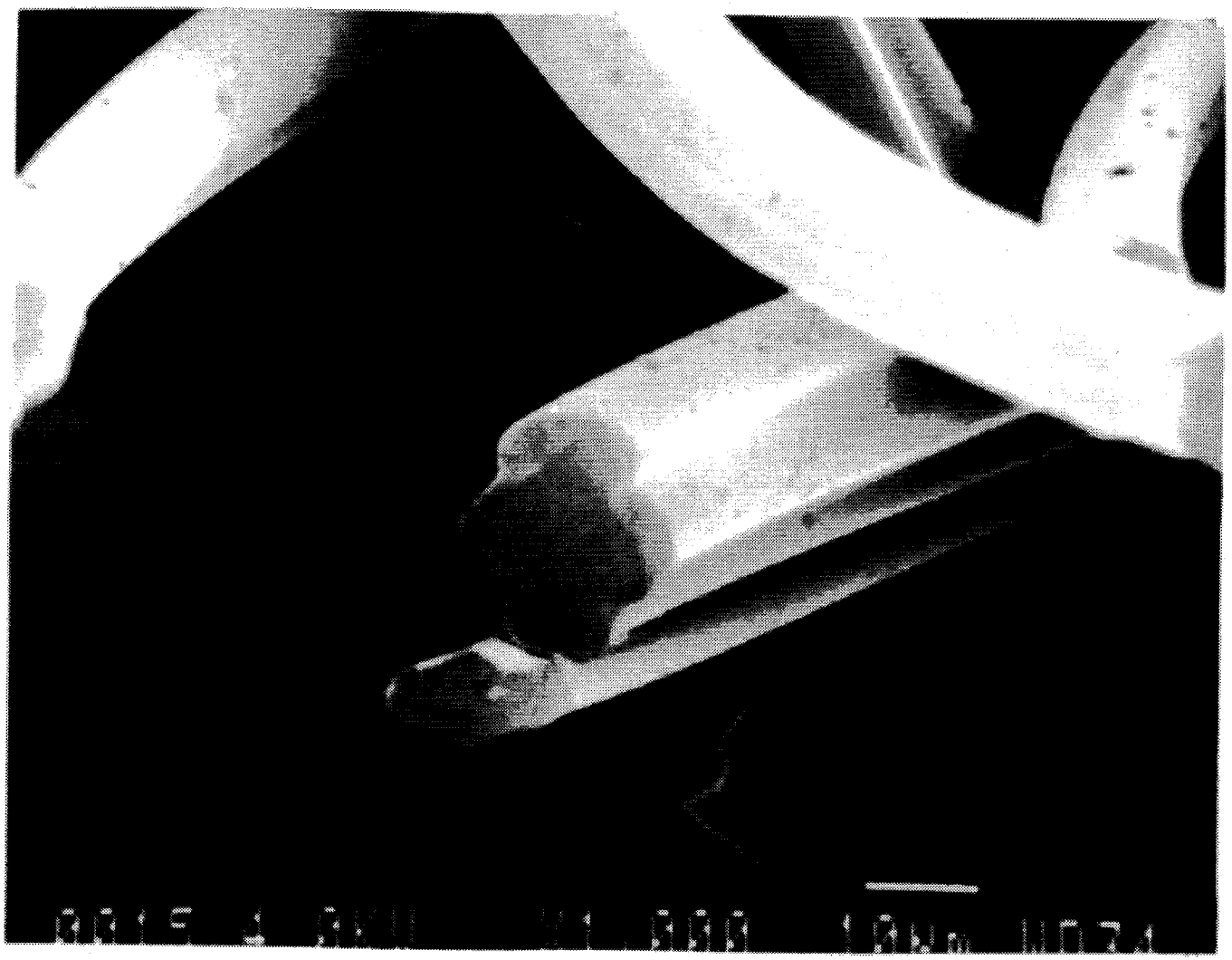
FIGS. 1 to 3 are magnified photographs of filament cross-sections as will be explained hereinafter in more detail.
Figure 2:
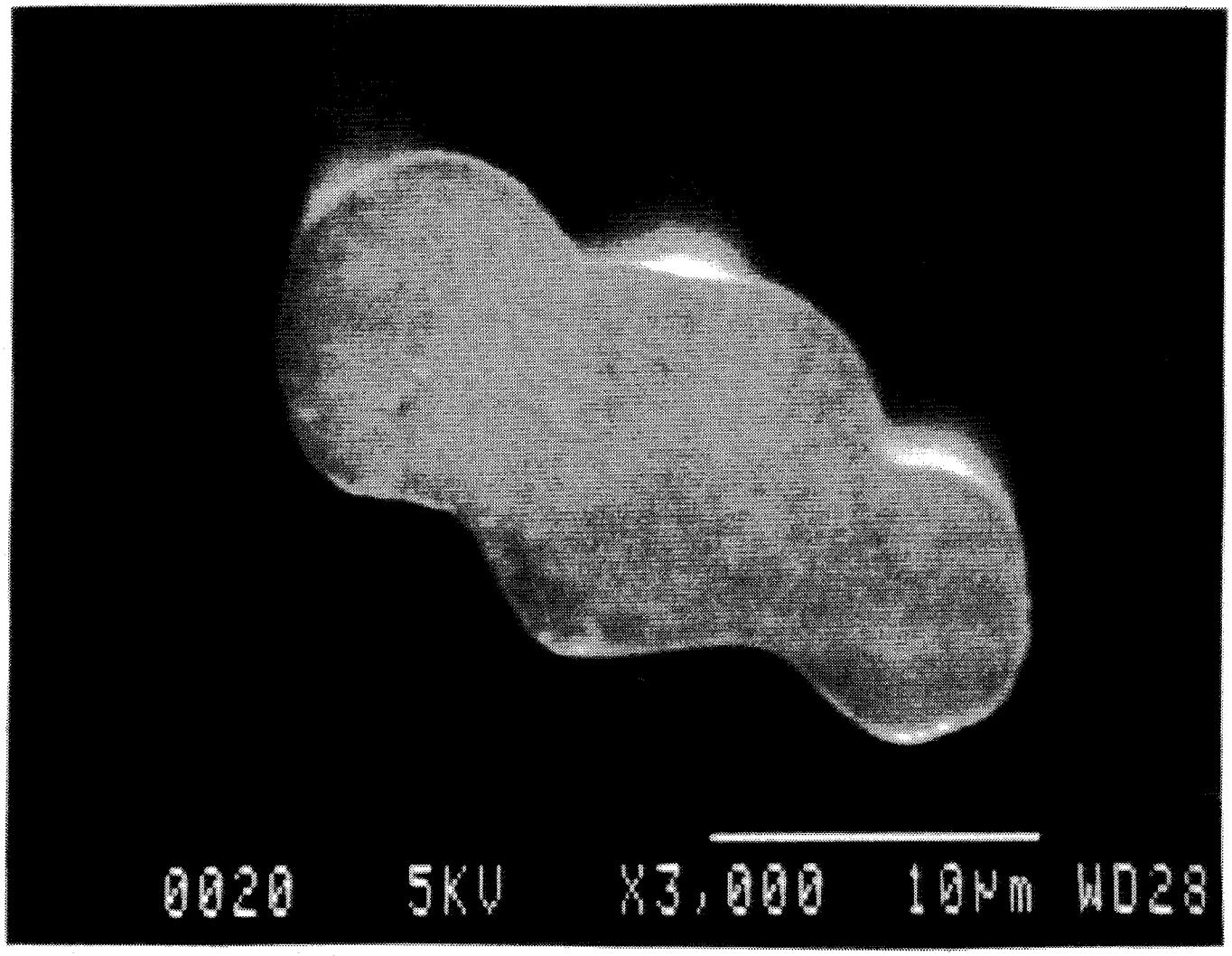
Figure 3:
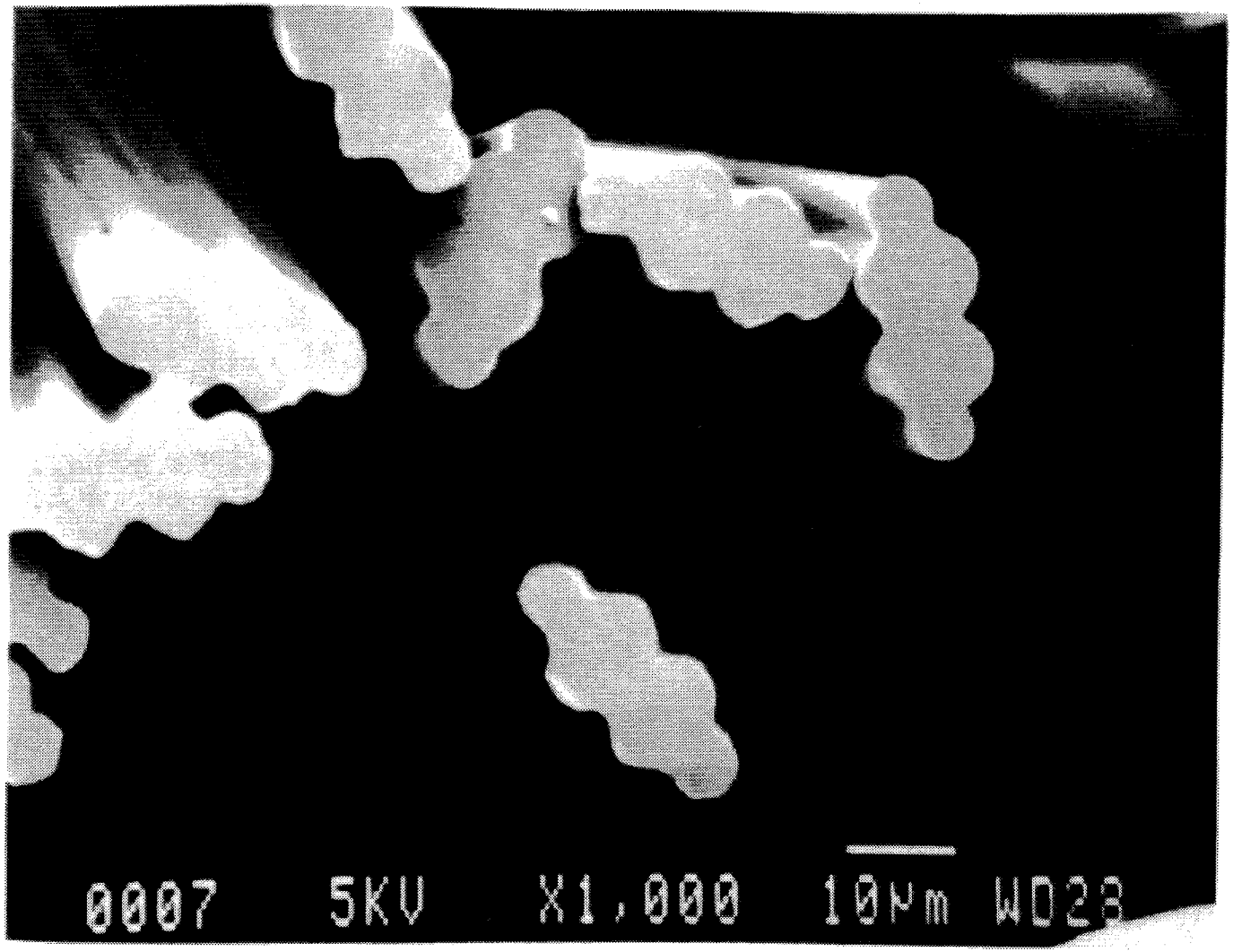

The cross-sections of the polyester filament used according to my invention should not be round but generally oval in shape with grooves that run along the length of the filaments. Typical of such a cross-section is a scalloped-oval cross-section such as was disclosed by Gorrafa in U.S. Pat. No. 3,914,488, the disclosure of which is hereby expressly incorporated herein by reference. Tows of such filaments are described and illustrated in the Examples hereinafter, and a magnified (1000×) photograph of both types of filament is shown in FIG. 1 of the accompanying Drawings. FIG. 2 shows a scalloped-oval cross-section at even greater magnification (3000×). The term "oval" is generic including elongated shapes that are not round, but have an "aspect ratio" (ratio of length to width of cross-section) that is more than 1, preferably more than about 1/0.7 (corresponding to a major axis length A:minor axis length B as disclosed by Gorrafa of 1.4); and preferably less than about 1/0.35 (corresponding to Gorrafa's preference of up to about 2.4), at least so far as concerns scalloped-oval. Provision of grooves (indentations or channels) is also important as disclosed by Gorrafa and related art, and in my copending patent application DP-6365, No. 08/497,499, filed simultaneously herewith on Jun. 30, 1995, the disclosure of which is also hereby expressly included herein by reference, and which has somewhat different preferences for aspect ratio, as disclosed therein. FIG. 3 shows such a cross-section of a preferred hexachannel polyester filament at 1000× magnification.

The crimping and drawing and most other product and processing conditions and characteristics have been described in the art, e.g., that referred to.

The polyester polymer used to make the filaments should be chain-branched, as indicated in the Examples. This technology has long been disclosed in various art, including Mead and Reese U.S. Pat. No. 3,335,211, MacLean et al. U.S. Pat. Nos. 4,092,299 and 4,113,704, Reese U.S. Pat. No. 4,833,032, EP 294,912, and the art disclosed therein, by way of example. Tetraethylsilicate (TES) is preferred as chain-brancher according to the present invention. The amount of chain-brancher will depend on the desired result, but generally 0.3 to 0.7 mole % of polymer will be preferred. The polyester polymer should desirably be essentially 2G-T homopolymer (other than having chain-brancher content), i.e., poly(ethylene terephthalate), and should preferably be of low relative viscosity, and polymers of LRV about 8 to about 12 have been found to give very good results as indicated hereinafter in the Examples. As disclosed by Mead and Reese, an advantage of using TES is that it hydrolyzes later to provide a desirable low pilling product. However, use of radially-directed quench air from a profiled quench system as disclosed by Anderson et al. in U.S. Pat. No. 5,219,582 is preferred, especially when spinning such low viscosity polymer. The relative viscosity (LRV) is defined in Broaddus U.S. Pat. No. 4,712,988.

As indicated in the Examples hereinafter, the proportions of the higher and lower denier filaments may vary, e.g., from 5 or 10 up to 90 or 95 percent of each type. Generally, however, approximately equal amounts will give very good results, e.g., 40–60% of each dpf type when two dpfs are mixed in the tow, and approximately one-third of each when three types are mixed, for example. These and other variations will often depend on what is desirable in downstream products, such as fabrics and garments. Aesthetic considerations are very important in apparel and other textile applications. Worsted apparel applications include, for example, men's and women's tailored suits, separates, slacks, blazers, military and career uniforms, outerwear and knits.

Figure 4:
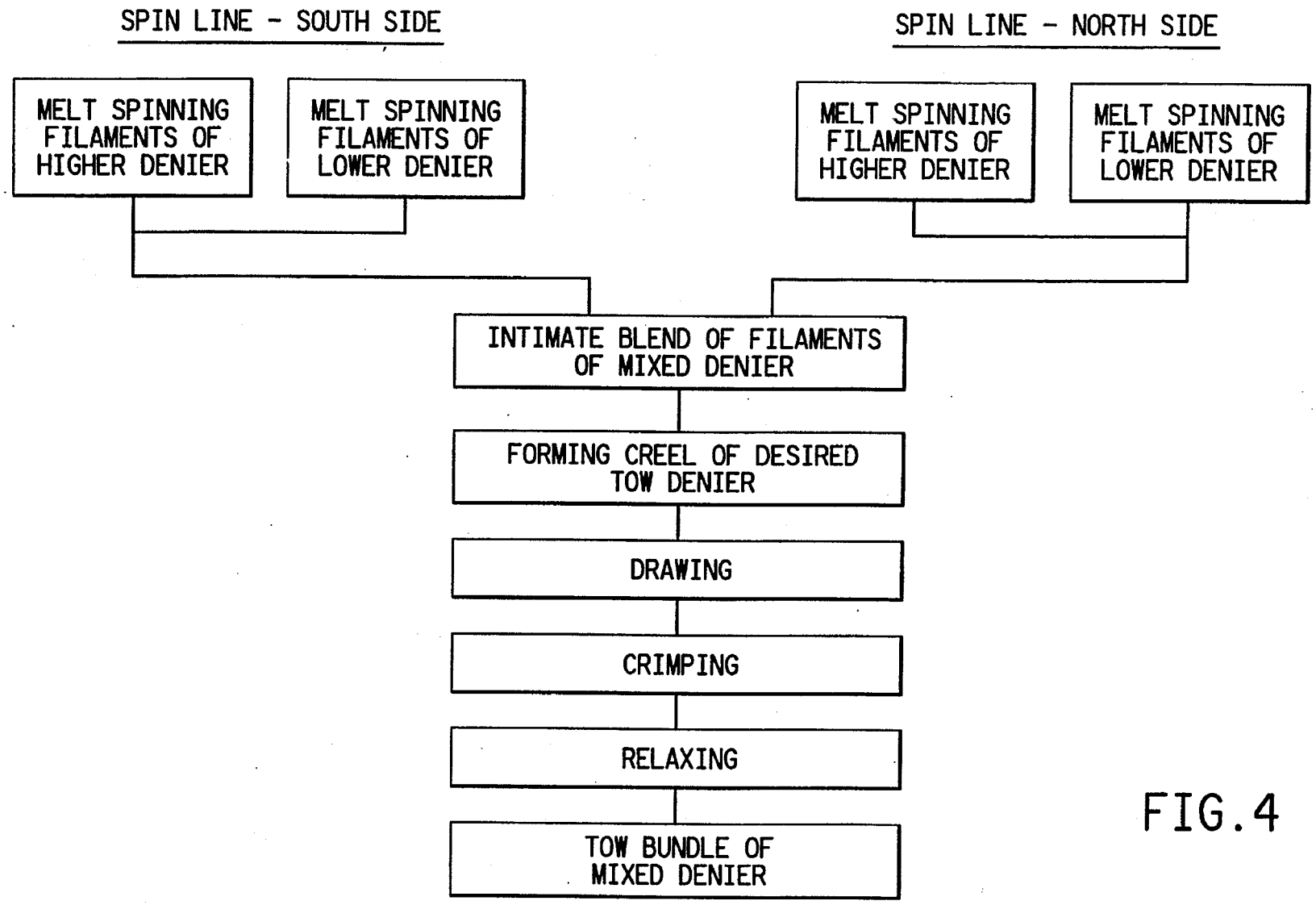
FIG. 4 is a block diagram to show typical process steps by which a tow of the invention may be prepared.

As indicated hereinafter and in the Background hereinbefore, tows of the invention (including their resulting slivers) maybe processed with advantages on the worsted system. Typical process preparation steps are illustrated schematically by a block diagram in FIG. 4 of the Drawings, and are also described hereinafter in the Examples; these generally follow normal procedures, except insofar as described herein, especially as the present invention concerns filaments having more than one filament denier, both (or all) of which are prepared and then mixed together instead of making a tow of filaments of a single (nominal) denier. As described in some of the Examples, similar bundle throughputs per spinning position are preferably used, so the bundle of extruded filaments encounter similar heat loads during quenching of the bundle of freshly-extruded filaments, as this can often be advantageous during subsequent processing, such as simultaneous drawing of the tow.

EXAMPLES

The invention is further illustrated in the following Examples, which, for convenience, refer to processing on the worsted system, which is generally more important, but the tows of the invention could also be processed on a woollen system. All parts and percentages are by weight unless otherwise indicated. Most test procedures are well known and/or described in the art. For avoidance of doubt, the following explanation of procedures that I used are given in the following paragraphs.

The average stress-strain curves are obtained as follows as an average of 10 individual filaments of each type taken from the tow bundle. Ten samples of each of the higher and of the lower denier filaments are separated from the tow bundle using a magnifying glass (LUXO Illuminated Magnifier). The denier (per filament, dpf) of each sample filament is measured on a VIBROSCOPE (HP Model 201C Audio Oscillator). The sample filaments are then mounted one at a time on an INSTRON (Model 1122 or 1123) and the stress-strain behavior is measured. Ten breaks are recorded for each filament type, and the averages of the 10 samples are recorded for each filament type.

The fiber frictions are obtained using the following procedure. A test batt weighing 0.75 gram is made by placing fibers on a one-inch wide by 8-inch long adhesive tape. For fiber-to-fiber friction measurements, 1.5 grams of fibers are attached to a 2-inch diameter tube that is placed on a rotating tube on the mandrel. One end of the test batt is attached to a strain gauge and draped over the fiber-covered mandrel. A 30-gram weight is attached to the opposite end and tensions are measured as the mandrel rotates at various speeds over a range of 0.0016–100 cm/sec. When fiber-to-metal friction is measured, a smooth metal tube is used instead of the tube covered with 1.5 grams of fibers, but the procedure is otherwise similar. The coefficients of friction are calculated from the tensions that are measured.

EXAMPLE I

Figure 5:
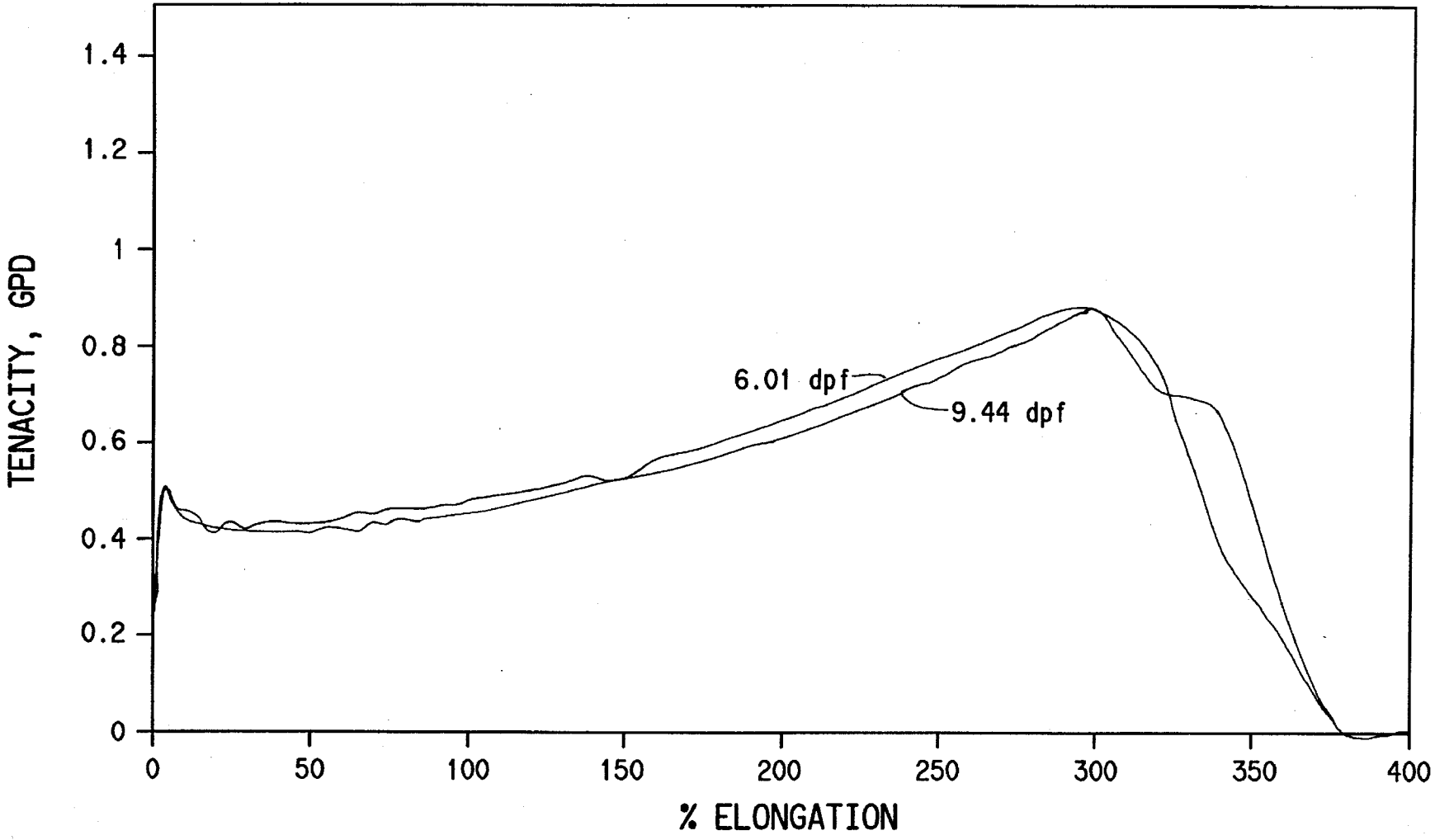
FIGS. 5, 6 and 7 are stress-strain curves for higher and lower denier single filaments as will be explained hereinafter in more detail.

Filaments of poly(ethylene terephthalate) of mixed dpf (approximately 40% by weight being of 6.0 dpf, 60% by weight being of 9.4 dpf) were melt-spun at 282° C. from polymer containing 0.40 mole percent tetraethyl orthosilicate (as described in Mead, et al., U.S. Pat. No. 3,335,211) and having a relative viscosity of 10.1 (determined from a solution of 80 mg of polymer in 10 ml of hexafluoroisopropanol solvent at 25° C.). The polymer was extruded at a rate of 90 lbs./hr. per position from 44 positions in all. 17 positions, with 9 positions on one side of machine and 8 positions on the other, produced the low denier (6.0) filaments. 27 positions, with 13 positions on one side and 14 positions on the other, produced the heavy denier (9.4) filaments. The orifice shape for each of the spinneret capillaries was three diamonds joined together to give filaments of scalloped-oval cross-section as described by Gorrafa U.S. Pat. No. 3,914,488. The smaller filaments were spun from a spinneret containing 711 capillaries while larger filaments were spun from a spinneret containing 450 capillaries. All these filaments were spun at a withdrawal speed of 1600 ypm and quenched using radially-directed air from a profiled quench system, as described in Anderson, et al., U.S. Pat. No. 5,219,582. The spun tow was collected in a can and consisted of a mixture of lower and higher denier filaments, thus being according to the invention. The total denier of the tow was approximately 187,096, and the total number of filaments was 24,237. The as-spun filament properties are indicated in Table 1A. Average stress-strain curves of single filaments (taken from the tow) are shown in FIG. 5 for lower and higher dpf filaments.

TABLE 1A

| | Conc. % | DPF | Mod gpd | Ten gpd | Elong % | Aspect Ratio |
|---|---|---|---|---|---|---|
| Higher dpf | 60 | 9.4 | 18 | 1.0 | 334 | 1/0.64 |
| Lower dpf | 40 | 6.0 | 17 | 1.0 | 334 | 1/0.71 |

Twelve cans of spun supply were combined together to give a tow amounting to 290,844 filaments and of total denier approximately 2.3 million. This tow was drawn at a draw ratio of 3.0× in 95° C. spray draw of water. I was surprised that it was possible to draw an intimate mixture of as-spun filaments of different denier simultaneously (whose natural draw ratio had not been adjusted at the same draw ratio in the same tow), i.e., to give drawn filaments that were satisfactory and with no dark dye defects. In other words, I was surprised that it was possible to spin these undrawn filaments of this polyethylene terephthalate (modified with tetraethyl orthosilicate) that had been spun of significantly different denier on the same spinning machine without adjusting the natural draw ratio and then subsequently to draw them to provide filaments with excellent properties (which are different because of their differing dpfs) and to provide eventually fabrics and garments of superior tactility.

The tow was then passed through a stuffer box crimper and subsequently relaxed at 130° C. to give a final tow of total denier approximately 861,000, of average denier about 3 dpf, and containing filaments of both lower and higher denier. The dram properties are listed in Table 1B:

TABLE 1B

| | Conc. % | DPF | Mod gpd | Ten gpd | Elong % | CPI | Aspect Ratio |
|---|---|---|---|---|---|---|---|
| Higher dpf | 60 | 3.6 | 40 | 2.3 | 31 | 6.8 | 1/0.53 |
| Lower dpf | 40 | 2.3 | 43 | 2.4 | 21 | 7.4 | 1/0.48 |

A conventional finish was applied to provide a finish level on the fiber of 0 0.15% by weight. The effective/nominal denier per filament (i.e., the denier of the total tow bundle divided by the number of filaments) was 3.0 dpf, about 40% of the filaments (by weight), however, being of 2.3 denier and the remaining 60% being of 3.6 denier. The tow was collected in a conventional tow box and sent to a mill for downstream processing, blending with wool, and yarn conversion.

Figure 8:
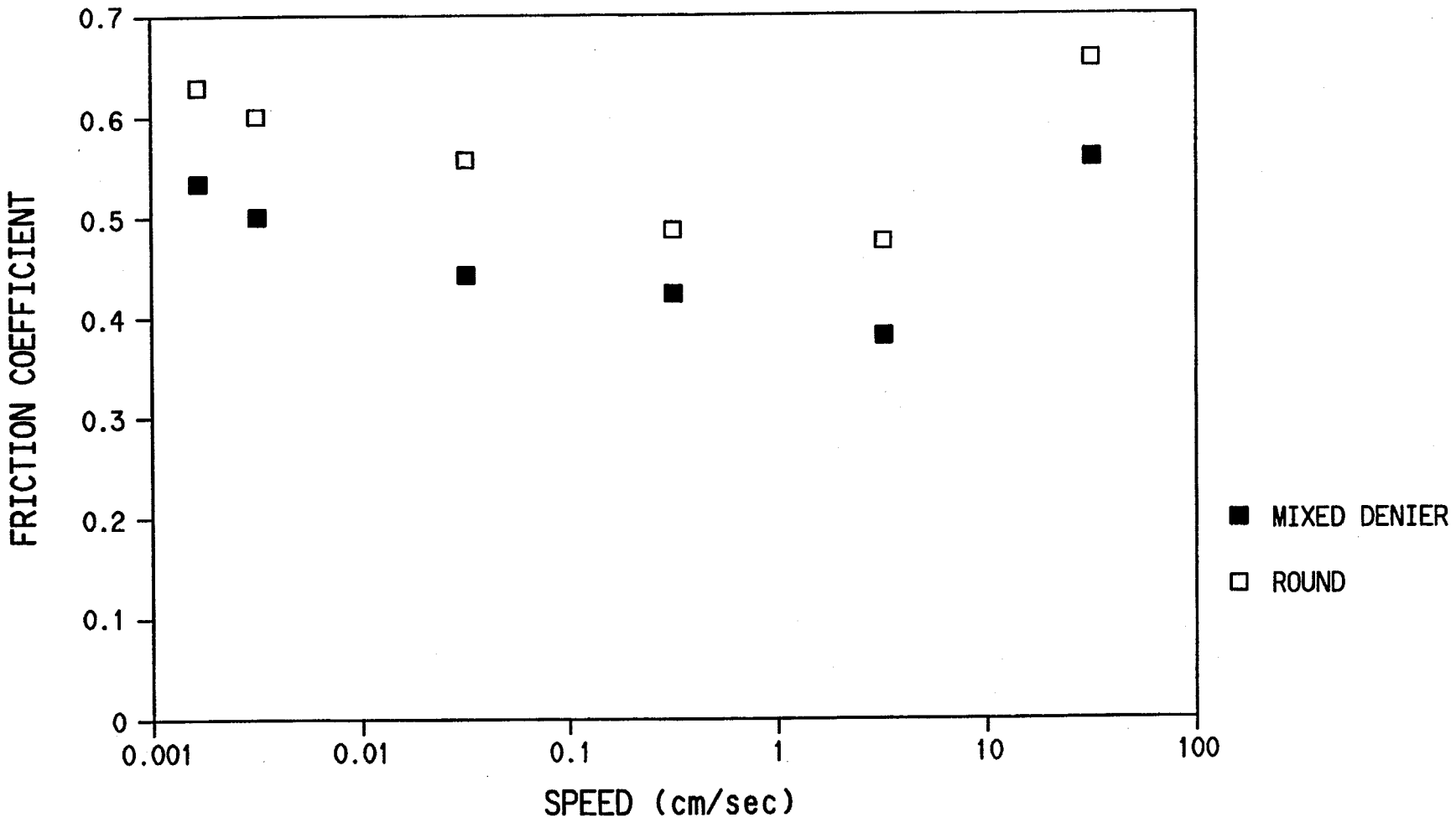
Figure 9:
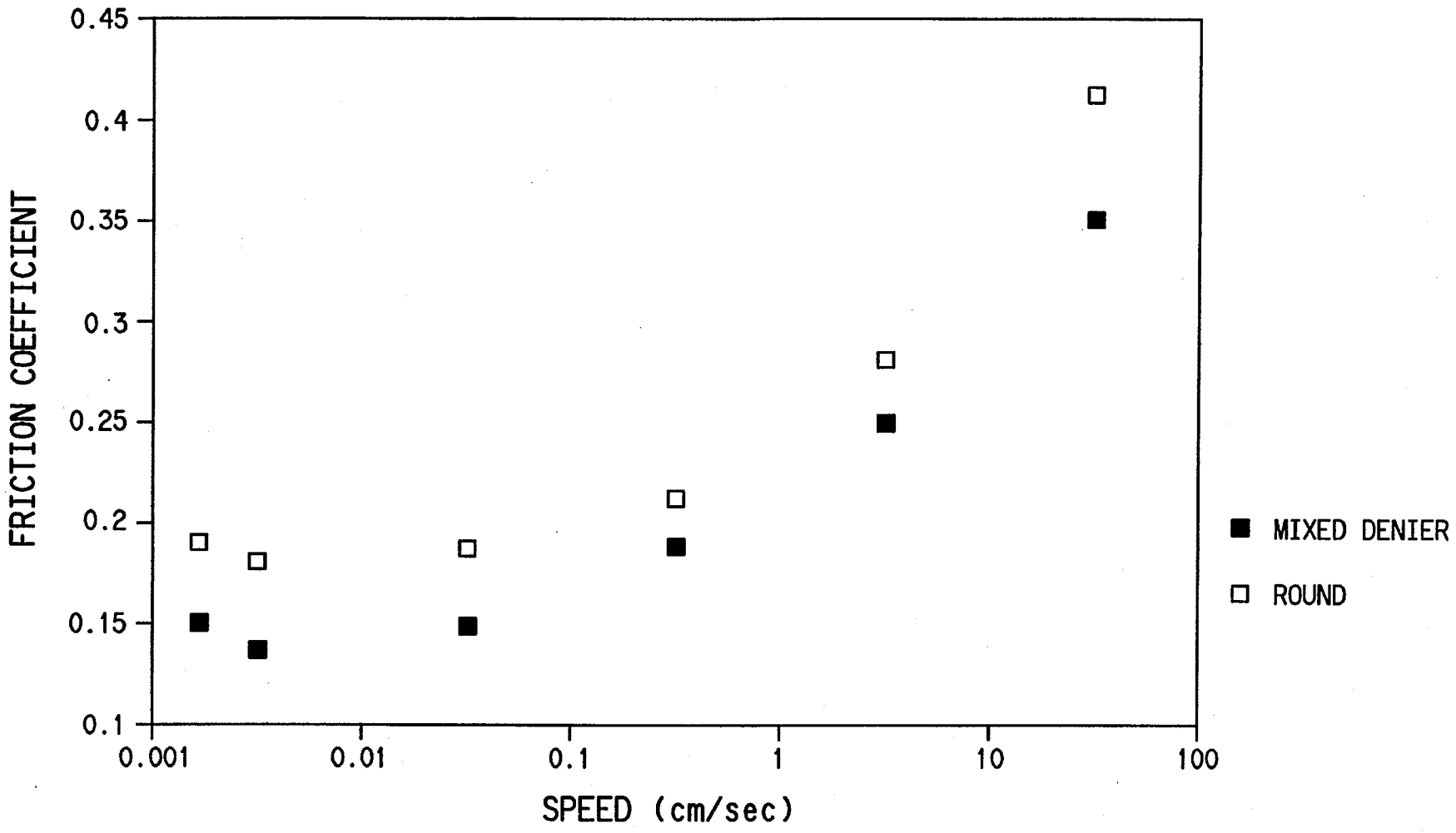

Successful mill processing of tow (including cutting to form a continuous sliver, dyeing, and pin drafting, gilling, etc.) is critical for commercial viability. Poor pin drafting results in process efficiency loss and/or unacceptable product quality. I was surprised that processing the tow and resulting sliver from the present example (with fibers of mixed-denier, scalloped-oval cross-section) was significantly superior to processing of tow that was similar, except that it contained fibers of round cross-section (and of unmixed dpf), and I believe that the latter were possibly hard to process due to the effect of unacceptably high levels of fiber-to-fiber and fiber-to-metal friction during various pin drafting operations. The friction characteristics of the two types are shown and compared in FIGS. 8 and 9.

EXAMPLE II

Figure 6:
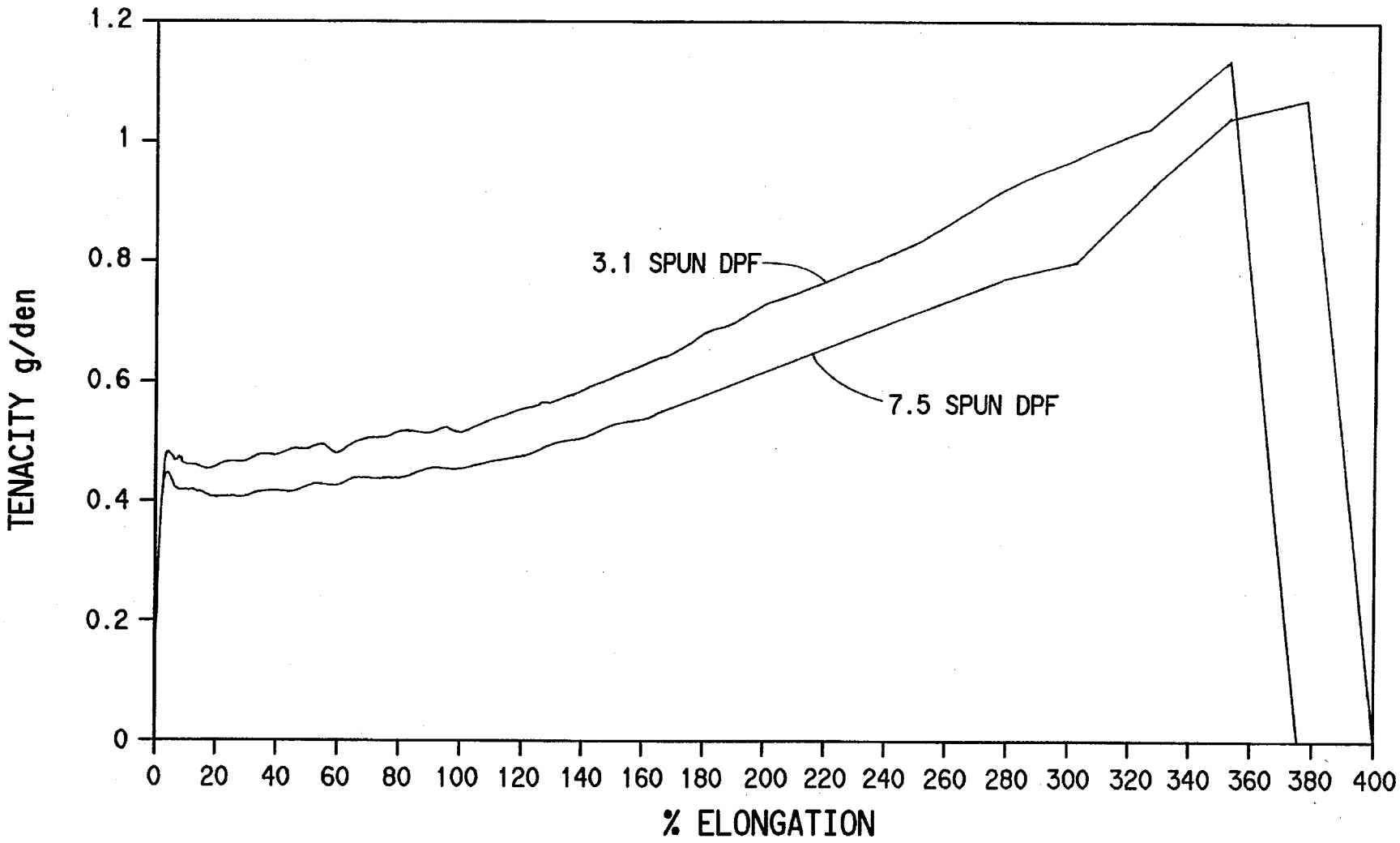

Filaments of similar scalloped-oval cross-section were spun in approximately equal amounts (by weight) of lower denier (3.1 dpf) and higher denier (7.2 dpf), but otherwise essentially similarly to the procedure described in Example I at a rate of 70 lbs./hr. per position from a 48-position spin machine. Twenty-four positions, with 12 positions on each side of the machine, produced lower denier filaments. Similarly, 24 positions, with 12 positions on each side of the machine, produced higher denier filaments. The smaller filaments were spun from spinnerets containing 1054 capillaries while the larger filaments were spun from spinneret containing 450 capillaries. The total denier of the spun tow collected in a can was approximately 156,178. As-spun properties are indicated in Table 2A. Average stress-strain curves (as for Example I) are shown in FIG. 6.

TABLE 2A

| | Conc. % | DPF | Mod gpd | Ten. gpd | Elong. % | Aspect Ratio |
|---|---|---|---|---|---|---|
| Higher dpf | 50 | 7.2 | 18 | 1.0 | 331 | 1/0.66 |
| Lower dpf | 50 | 3.1 | 16 | 1.0 | 301 | 1/0.62 |

Fourteen cans of spun supply were combined together to provide a tow with a total denier of approximately 2.2 million, that was drawn, crimped, and relaxed essentially as described in Example I to give a final tow size of approximately 812,000 denier. The drawn properties are listed in Table 2B:

TABLE 2B

| | Conc. % | DPF | Mod gpd | Ten gpd | Elong % | CPI | Aspect Ratio |
|---|---|---|---|---|---|---|---|
| Higher dpf | 50 | 3.0 | 39 | 2.5 | 28 | 10.2 | 1/0.65 |
| Lower dpf | 50 | 1.2 | 38 | 2.9 | 30 | 10.2 | 1/0.68 |

Conventional finish was applied, as in Example I. The effective/nominal denier was 2.0 dpf, about 50% of the filaments (by weight) being 1.2 dpf and 50% being 3.0 dpf. The tow was collected in a conventional tow box and sent to a mill for downstream processing, blending with wool, and yarn conversion.

I was surprised that the tow of this Example processed well through various mill processing stages involving crush cutting to a specified length, dyeing and pin drafting because a tow consisting of 2 dpf (unmixed dpf) round fiber geometry did not process acceptably but caused productivity, efficiency, and quality problems. In Example VII hereinafter, a tow of even lower dpf filaments was made and processed successfully.

EXAMPLE III

In Example I, a mixed dpf tow of filaments of scalloped-oval cross-section was spun having 60% of higher dpf filaments and 40% of lower dpf. This Example III was carried out using essentially the same procedure, except that the proportions were 50/50 (again by weight), by appropriately adjusting the numbers of ends (spinning positions) which spun (extruded) lower and higher dpf filaments and, where necessary, the number of capillaries per end (spinning position). Thus, for the 50/50 blend, an equal number of spinnerets (22 each) of 450 capillaries per end and 1054 capillaries per end were used at throughputs of 90 lbs./hr./end. For 100% of a given fiber, only one spinneret type was used on the spin machine. These tows and their slivers demonstrated good downstream processing characteristics. Data is tabulated in Table 3.

TABLE 3

| | | | | | | Spun Properties | | | | | Drawn Properties | | | | | |
|---|---|---|---|---|---|---|---|---|---|---|---|---|---|---|---|---|
| No. | Filament Type | Blend Comp By Wt % | Thruput/ End Lbs./hr. | Number Capillaries per end | Number Spinning Positions | DPF | Mod gpd | Ten gpd | Elong % | Aspect Ratio | DPF | Mod gpd | Ten gpd | Elong % | CPI | Aspect Ratio |
| 1 | Large | 50 | 90 | 450 | 22 | 9.7 | 17 | 0.8 | 287 | 1/0.66 | 3.6 | 37 | 2.4 | 31 | 8.0 | 1/0.57 |
| | Small | 50 | 90 | 1054 | 22 | 4.1 | 19 | 1.0 | 289 | 1/0.68 | 1.6 | 43 | 2.9 | 35 | 9.6 | 1/0.51 |
| 2 | Single | 100 | 90 | 450 | 44 | 9.2 | 20 | 1.1 | 336 | 1/0.64 | 3.2 | 41 | 2.9 | 19 | 9.0 | 1/0.61 |
| 3 | Single | 100 | 90 | 711 | 44 | 6.0 | 19 | 1.0 | 333 | 1/0.67 | 2.3 | 44 | 2.6 | 37 | 8.8 | 1/0.58 |

TABLE 4

| | | | | | | Spun Properties | | | | | Drawn Properties | | | | | |
|---|---|---|---|---|---|---|---|---|---|---|---|---|---|---|---|---|
| No. | Filament Type | Blend Comp By Wt % | Thruput/ End Lbs./hr. | Number Capillaries per end | Number Spinning Positions | DPF | Mod gpd | Ten gpd | Elong % | Aspect Ratio | DPF | Mod gpd | Ten gpd | Elong % | CPI | Aspect Ratio |
| 1 | Single | 100 | 73.8 | 450 | 48 | 7.5 | 16 | 1.0 | 347 | 1/0.64 | 2.9 | 41 | 2.7 | 44 | 6.8 | 1/0.64 |
| 2 | Large | 60 | 70 | 711 | 29 | 4.8 | 18 | 1.0 | 326 | 1/0.67 | 1.9 | 46 | 2.8 | 50 | 9.2 | 1/0.69 |
| | Small | 40 | 70 | 1054 | 19 | 3.2 | 18 | 1.1 | 339 | 1/0.64 | 1.3 | 42 | 2.9 | 41 | 9.2 | 1/0.64 |
| 3 | Single | 100 | 70 | 1054 | 48 | 3.1 | 17 | 1.0 | 315 | 1/0.61 | 1.2 | 43 | 3.0 | 30 | 9.4 | 1/0.66 |

EXAMPLE IV

In Table 4, data are summarized for fibers spun essentially as described for Table 3, but for filaments prepared by a procedure essentially as described in Example II, and wherein the relative proportions and denier were varied. Thus, for the 60/40 blend, 29 spinnerets of 711 capillaries/end and 19 spinnerets with 1054 capillaries/end were used at throughputs of 70 lbs. per hour per end. These tows and their slivers demonstrated good downstream processing characteristics.

EXAMPLE V

Filaments of poly(ethylene terephthalate) of 3.2 dpf were melt-spun essentially as described in Example 2, but were extruded at a rate of 72.8 lbs./hr. from a single position from a spinneret containing 1054 capillaries and wound on a bobbin to give a total filament bundle denier of 3445.

Filaments of 7.8 dpf were similarly melt-spun and wound on a bobbin to give a total filament bundle denier of 3492 being extruded at a rate of 75.2 lbs./hr. from a spinneret containing 450 capillaries at this single position.

The as-spun properties are indicated in Table 5A:

TABLE 5A

| | DPF | Mod gpd | Ten gpd | Elongation % | Aspect Ratio |
|---|---|---|---|---|---|
| Higher dpf | 7.8 | 20 | 0.8 | 287 | 1/0.68 |
| Lower dpf | 3.2 | 20 | 0.9 | 221 | 1/0.66 |

Three bobbins of 3.2 dpf filaments and 29 bobbins of 7.8 dpf filaments were combined to form a tow having a nominal blend ratio of 10/90 lower/higher dpf filaments for simultaneous draw. The tow was drawn at a draw ratio of 2.6× in 95° C. spray draw of water. The tow was then passed through a stuffer box crimper and subsequently relaxed at 145° C. to give a final tow size of approximately 47,000 denier of an intimate blend containing lower and higher denier filaments, with a nominal (average) dpf of about 3.0, whose filament properties are listed in Table 5B:

TABLE 5B

| | Blend Conc % | Dpf | Mod gpd | Ten gpd | Elong % | CPI | Aspect Ratio |
|---|---|---|---|---|---|---|---|
| Higher dpf | 92 | 3.3 | 50 | 2.2 | 26 | 7.7 | 1/0.65 |
| Lower dpf | 8 | 1.2 | 43 | 3.0 | 30 | 9.4 | 1/0.64 |

Conventional finish was applied as in Example I. The effective/nominal denier was 3.0 dpf, about 8% (by weight) of the filaments being 1.2 dpf and 92% being 3.3 dpf. The tow was collected in a conventional tow box and sent to a mill for downstream processing, blending with wool for yarn conversion and then into fabrics.

How a tow (and the resulting sliver) processes in a mill is critical for commercial viability. To estimate product performance in the mill, sliver cohesion tests, a measure of fiber-to-fiber friction, were performed both before and after dyeing. Sliver cohesion tests consist of carding to make a sliver 12 inches long, hanging the sliver vertically and adding weights at the bottom until a load-bearing limit is reached (i.e., the fibers in the sliver pull apart and the weight(s) drop). For dyed items, the slivers were tightly compacted into nylon bags and pressure-dyed at 250° F. (121° C.) for 30 minutes with disperse blue G/F dye. The samples were dried in a forced air oven at 270° F. (132° C.) for 30 minutes and the sliver cohesion measured. Such tests reflect the magnitude of the frictional property change between items before and after dyeing. For comparison, sliver cohesion tests were performed on slivers of 3.0 dpf round fiber (of same polymer and of matching CPI and crimp index) currently sold commercially. The results of the sliver cohesion tests are given in Table 5C.

TABLE 5C

| Item and Fiber Geometry | CPI | Sliver Cohesion Before Dyeing mg/denier | Sliver Cohesion After Dyeing mg/denier |
|---|---|---|---|
| 3 dpf - 100% Round | 8.2 | 3.54 | 5.91 |
| 3 dpf (8/92 blend) - Scalloped Oval | 7.3–8.2 | 1.07 | 2.10 |

A comparison of the sliver cohesion values obtained shows that the sliver from the tow of the invention (mixed dpf of scalloped-oval cross-section) had much lower sliver cohesion values, only 30% of that of a conventional single dpf (unmixed) round fiber-type sliver (also of 3 dpf), before dyeing and only 36% of the conventional type after dyeing. These may explain in retrospect why the tow of the invention (and its resulting sliver) processed much better.

EXAMPLE VI

In Table 6, data are summarized for tows of mixed dpf filaments prepared essentially as described for Example V, but wherein the relative concentration of lower and higher deniers and their respective deniers are varied. As explained before, the denier is varied by changing polymer throughput rate through the capillary, while the relative concentration in the blend is varied by changing the number of bobbins of a given denier in the blend prior to drawing.

TABLE 6

| | | | | Spun Properties | | | | | | | | Drawn Properties | | | | |
|---|---|---|---|---|---|---|---|---|---|---|---|---|---|---|---|---|
| Item | Type | Thruput per End Lbs./hr. | Number Capillaries per end | DPF | Mod gpd | Ten gpd | Elong % | Aspect Ratio | No. of Bobbins | Draw Rate X | Blend Conc. % | DPF | Mod gpd | Ten gpd | Elong % | CPI |
| 1 | Higher dpf | 84.2 | 450 | 8.7 | 19 | 0.9 | 327 | 1/0.68 | 18 | 2.6 | 60 | 3.7 | 45 | 2.2 | 48 | 6.5 |
| | Lower dpf | 48.8 | 450 | 5.0 | 20 | 0.8 | 251 | 1/0.65 | 20 | | 40 | 2.2 | 51 | 2.7 | 16 | 8.5 |
| 2 | Higher dpf | 93.0 | 450 | 9.6 | 19 | 0.9 | 319 | 1/0.67 | 11 | 2.6 | 40 | 4.1 | 46 | 2.2 | 47 | 7.9 |
| | Lower dpf | 55.4 | 450 | 5.7 | 19 | 0.8 | 254 | 1/0.65 | 27 | | 60 | 2.5 | 48 | 2.3 | 30 | 6.4 |
| 3 | Higher dpf | 59.8 | 243 | 11.4 | 19 | 0.9 | 314 | 1/0.66 | 9 | 2.6 | 20 | 4.9 | 37 | 2.3 | 40 | 9.9 |
| | Lower dpf | 59.8 | 450 | 6.2 | 18.5 | 0.8 | 274 | 1/0.65 | 33 | | 80 | 2.6 | 43 | 2.4 | 29 | 15.8 |
| 4 | Higher dpf | 69.0 | 450 | 7.1 | 21 | 0.8 | 303 | 1/0.65 | 20 | 2.7 | 50 | 2.8 | 51 | 2.5 | 15 | 7.6 |
| | Lower dpf | 46.0 | 1054 | 2.1 | 25 | 0.9 | 188 | 1/0.65 | 30 | | 50 | 0.8 | 75 | 3.0 | 11 | 11 |

EXAMPLE VII

Figure 7:
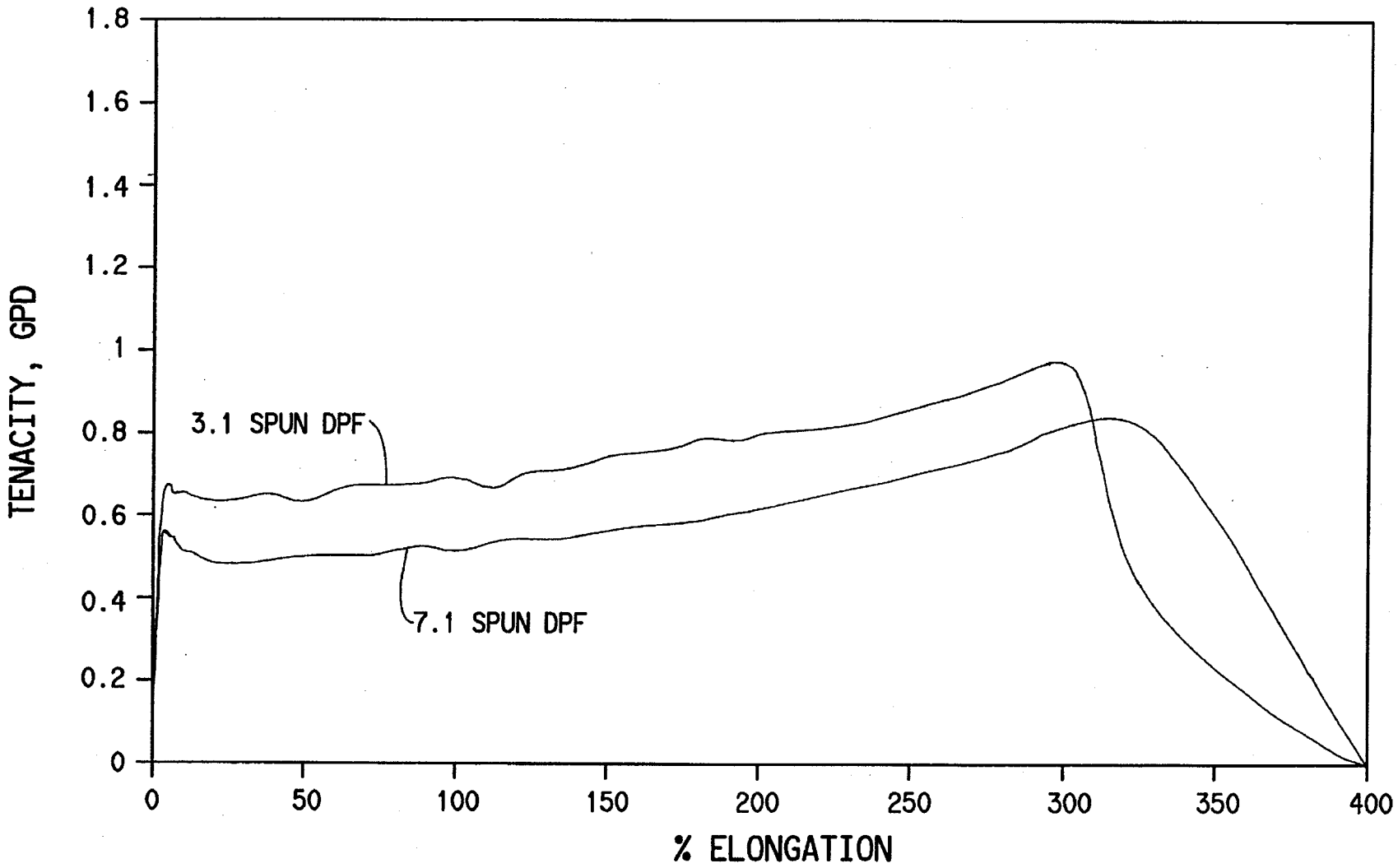

A mixed dpf tow of filaments of poly(ethylene terephthalate) in a mixture of approximately 80% by weight of 3.1 dpf and 20% by weight of 7.2 dpf was prepared by melt-spinning (from polymer containing 0.58 mole percent tetraethyl orthosilicate and having a relative viscosity of 8.9) essentially as described in Example II, except that 38 positions, with 19 positions on one side of the machine and 19 positions on the other side, produced the lower denier filaments and 10 positions, with 5 positions on one side and 5 on the other side, produced the higher denier filaments. The spun tow collected in a can had a total denier of approximately 157,000. As-spun properties are indicated in Table 7A. Average stress-strain curves (as for Examples 1 and 2) are shown in FIG. 7.

TABLE 7A

| | Conc. % | DPF | Mod gpd | Ten gpd | Elong % | Aspect Ratio |
|---|---|---|---|---|---|---|
| Higher dpf | 20 | 7.2 | 21 | 0.9 | 303 | 1/0.65 |
| Lower dpf | 80 | 3.1 | 22 | 1.0 | 195 | 1/0.64 |

Fifteen cans of spun supply were combined together for a total tow denier of approximately 2.2 million, that was drawn, crimped and relaxed essentially as described in Example I to give a final tow size of approximately 900,000 denier. The resulting properties are listed in Table 7B:

TABLE 7B

| | Conc. % | DPF | Mod gpd | Ten gpd | Elong % | CPI | Aspect Ratio |
|---|---|---|---|---|---|---|---|
| Higher dpf | 20 | 2.85 | 51.3 | 2.49 | 14.78 | 7.56 | 1/0.65 |
| Lower dpf | 80 | 1.20 | 65.4 | 2.86 | 12.50 | 8.76 | 1/0.64 |

Conventional finish was applied as in Example I. The effective/nominal denier was 1.5 dpf, about 20% of the filaments being of 2.9 dpf and 80% being 1.2 dpf. The tow was collected in a conventional tow box and sent to a mill for downstream processing, including stretch-breaking, followed by blending with wool, yarn conversion, and fabric making.

EXAMPLE VIII

Mixed dpf tows spun essentially as described in Example III, Item 1, were processed, including being drawn at different draw ratios (DR) so the final product could be scrutinized for product quality defect level, as indicated hereinafter in Table 8. Product defects may be classified into three categories: 1) Equivalent Fabric Defects (EFD), 2) Dark Dye Defect (DDD), 3) Splinters (SPL). The first two defects (EFD and DDD) are fibers and clumps of fibers that dye darker than normal fibers. DDDs have a diameter less than 4× the normal (drawn) fiber diameter. EFDs have a diameter 4× the normal fiber diameter or greater. Both defects must be longer than 0.25 inches. Samples are processed through a roller top type card. The sliver is dyed light blue and examined visually under a lighted magnifying glass. Fibers that dye darker than the bulk of the sample are removed, classified as EFDs or DDDs and counted. Each type of defect is reported as number of defects per 0.1 pound sliver. Splinters are oversized fibers or clumps of fibers. To be classified as a splinter, this defect must be longer than 0.25 inch and the total diameter must be greater than 0.0025 inch. Splinters are concentrated in the flat strip waste when a staple sample is processed through a flat card. The flat strip waste is visually examined against a black background. Splinters are removed, classified by size, counted, and expressed on a weight of sample basis.

TABLE 8

| DR | Tow Denier | DPF | Crimp Take-up | CPI | Ten. gpd | Elong. % | EFD | DDD | SPL |
|---|---|---|---|---|---|---|---|---|---|
| 2.8 | 910,000 | Higher 3.8<br>Lower 1.6 | 30.5 | 8.3 | 2.4 | 33 | 0 | 0 | 0 |
| 2.9 | 877,000 | Higher 3.7<br>Lower 1.6 | 29.0 | 6.9 | 2.2 | 30 | 0 | 0 | 0 |
| 3.0 | 849,000 | Higher 3.6<br>Lower 1.5 | 29.0 | 7.5 | 2.8 | 26 | 0 | 0 | 0 |
| 3.1 | 821,000 | Higher 3.5<br>Lower 1.5 | 27.5 | 8.1 | 2.8 | 19 | 0 | 0 | 0 |
| 3.3 | 777,000 | Higher 3.3<br>Lower 1.4 | 27.5 | 7.0 | 2.8 | 19 | 0 | 0 | 0 |

In other words, the product quality was not adversely impacted by varying the draw ratio over such a draw range, and these various draw ratios did not give rise to observable fiber defects. In addition, throughput of the draw machine was not reduced by broken filaments or roll wraps.

EXAMPLE IX

Tow made essentially as described in Example II was treated with durable silicone elastomer finish prior to blending with wool. A 0.25% concentration of amino methyl polysiloxane copolymer of a 20% aqueous emulsion was made in a water bath at room temperature. The tow was processed at a rate of 8 lbs./hr. through the bath and dried in an oven at 300° F. (149° C.) for 5 minutes to cure the silicone. The resultant silicone level on the fiber was 0.3%. Application of this silicone improved the softness and resiliency of the resulting fabrics, because it reduced the fiber-to-fiber and yarn-to-yarn friction, so gave better aesthetics somewhat similar to previous experience with applying silicone slickener to fiberfill for use in filled articles.

EXAMPLE X

Filaments of 3.2 dpf were spun and wound as described in Example V to give a bobbin of such filaments with a total bundle denier of 3445.

Filaments of 7.3 dpf were prepared from the same polymer and otherwise essentially similarly except that they were extruded at a throughput rate of 70.8 lbs./hr. from a spinneret containing 450 capillaries at this single position and wound on a bobbin with a total bundle denier of 3284.

Filaments of 11.4 dpf were prepared similarly, except that the polymer was extruded at a rate of 59.8 lbs./hr. from 243 capillaries at a single position and wound on a bobbin to give a total bundle denier of 2771.

The as-spun properties are indicated in Table 10A:

TABLE 10A

| | DPF | Mod gpd | Ten gpd | Elongation % | Aspect Ratio |
|---|---|---|---|---|---|
| Large dpf | 11.4 | 19 | 0.9 | 315 | 1/0.66 |
| Medium dpf | 7.3 | 17 | 0.9 | 293 | 1/0.63 |
| Small dpf | 3.2 | 20 | 0.9 | 221 | 1/0.66 |

Eleven bobbins of 3.2 dpf, 12 bobbins of 7.3 dpf, and 14 bobbins of 11.4 dpf were combined to create a tow having approximately 33% by weight each of large, medium, and small dpf for a total tow size of 115,000 denier. This tow was drawn, crimped, and relaxed as described in Example V to give a final tow size of approximately 50,000 denier of an intimate blend containing light-, medium-, and heavy-denier filaments. Their properties are listed in Table 10B:

TABLE 10B

| | % | DPF | Mod gpd | Ten gpd | Elong % | CPI | Aspect Ratio |
|---|---|---|---|---|---|---|---|
| Large dpf | 33 | 4.9 | 43 | 2.4 | 29 | 15.8 | 1/0.65 |
| Medium dpf | 34 | 3.1 | 53 | 2.5 | 31 | 8.5 | 1/0.63 |
| Small dpf | 33 | 1.2 | 43 | 3.0 | 30 | 9.4 | 1/0.64 |

A conventional finish was applied as in Example I. The effective/nominal denier was 3.1 dpf, about 33% by weight being 4.9 dpf, 34% of 3.1 dpf and 33% of 1.2 dpf. Accordingly, this Example shows the invention is not limited to tows containing only two different dpfs, but more than two may be included in such tows, and their corresponding slivers and downstream products.

The Examples have demonstrated how filament tows of the invention may be prepared and processed, including their sliver processing, and subsequent processing into yarns, fabrics and garments. Aesthetics of the final downstream articles is very important, and all textile processing is performed with that end in view.

I claim:

1. A tow that is suitable for processing on a worsted or woollen system and that consists of continuous polyester filaments of average denier per filament up to 4.5, wherein said polyester is a chain-branched polymer, said filaments are a mixture of filaments of higher denier per filament and filaments of lower denier per filament, said lower denier is 0.5 to 2.5 denier per filament and said higher denier is 2 to 5 denier per filament and is at least 1.5 times said lower denier, and wherein the cross-sections of said filaments are of generally scalloped-oval shape with grooves, and said grooves run along the length of the filaments.

* * * * *